US008596234B2

(12) United States Patent
Choi et al.

(10) Patent No.: US 8,596,234 B2
(45) Date of Patent: Dec. 3, 2013

(54) ELECTRO-HYDRAULIC VARIABLE VALVE LIFT APPARATUS

(75) Inventors: Byong Young Choi, Incheon-si (KR); Jin Kook Kong, Suwon-si (KR); Soo Hyung Woo, Yongin-si (KR); Jin Soon Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 591 days.

(21) Appl. No.: 12/957,192

(22) Filed: Nov. 30, 2010

(65) Prior Publication Data

US 2012/0048222 A1 Mar. 1, 2012

(30) Foreign Application Priority Data

Aug. 25, 2010 (KR) ..... 10-2010-0082589

(51) Int. Cl.
*F01L 9/02* (2006.01)

(52) U.S. Cl.
USPC ..... 123/90.12; 123/90.55

(58) Field of Classification Search
USPC ..... 123/90.12, 90.13, 90.15, 90.16, 90.48, 123/90.52, 90.55
See application file for complete search history.

(56) References Cited

U.S. PATENT DOCUMENTS 8,408,173 B2 * 4/2013 Cho et al. ..... 123/90.16
8,468,985 B2 * 6/2013 Cho et al. ..... 123/90.12

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

An electro-hydraulic variable valve lift apparatus may includes a housing having a housing protruding portion is formed therewithin, a driving cam, a pump piston which forms a main chamber with the housing, reciprocates within the housing according to rotation of the driving cam, and forms hydraulic pressure within the main chamber, a pump piston elastic portion disposed for elastically supporting the pump piston, an oil pressure controller communicated with the main chamber in order to control hydraulic pressure within the main chamber, a hydraulic piston slidably disposed within the housing and connected with a valve, a multiple orifice unit slidably disposed within the hydraulic piston and forms an auxiliary chamber with the hydraulic piston, and the multiple orifice unit of which an orifice hole communicating the main chamber with the auxiliary chamber is formed thereto, and an orifice unit elastic portion disposed within the auxiliary chamber to elastically support the multiple orifice unit.

13 Claims, 7 Drawing Sheets

FIG. 3

| | High Lift Long Duration | High/Middle Ligt Long/Middle Duration | Low Lift Short Duration | Valve Deactivation |
|---|---|---|---|---|
| valve profile | | | | |
| driving range | high load | middle load | low load | CDA |
| oil drain time | non | top position of cam lobe (A) | before top position of cam lobe (B) | always |
| Ramp 구현 | open/close cam lobe ramp profile | cam lobe, close: hydraulic pressure | ↓ | non |

ELECTRO-HYDRAULIC VARIABLE VALVE LIFT APPARATUS

CROSS-REFERENCE TO RELATED APPLICATION

This application claims priority to and the benefit of Korean Patent Application No. 10-2010-0082589 filed in the Korean Intellectual Property Office on Aug. 25, 2010, the entire contents of which application is incorporated herein for all purposes by this reference.

BACKGROUND OF THE INVENTION

1. Field of the Invention

The present invention relates to a valve lift apparatus. More particularly, the present invention relates to an electro-hydraulic variable valve lift apparatus for an internal combustion engine.

2. Description of the Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches has been undertaken. For example, a valve for driving a valve is designed having different shapes, a variable valve lift apparatus has variable different lifts depending on an engine speed and so on.

However, since a CVVL (continuous variable valve lift apparatus) which is controlled mechanically, uses a link, eccentric cam a control shaft and so on, so that moment of inertia and accumulated clearance is relatively large, and development of dynamic characteristic of a valve is limited.

Also, each valve is controlled by the same camshaft simultaneously, realizing valve lift is limited.

The information disclosed in this Background section is only for enhancement of understanding of the general background of the invention and should not be taken as an acknowledgement or any form of suggestion that this information forms the prior art already known to a person skilled in the art.

SUMMARY OF THE INVENTION

The present invention has been made in an effort to provide an electro-hydraulic variable valve lift apparatus which may adjust valve lift according to engine operation condition. The electro-hydraulic variable valve lift apparatus may form a ramp profile when a valve is closed so as to reduce valve closing impact.

An electro-hydraulic variable valve lift apparatus according to various aspects of the present invention may include a housing of which a housing protruding portion is formed therewithin, a driving cam, a pump piston which forms a main chamber with the housing, reciprocates within the housing according to rotation of the driving cam, and forms hydraulic pressure within the main chamber, a pump piston elastic portion which is disposed for elastically supporting the pump piston, an oil pressure controller which is communicated with the main chamber in order to control hydraulic pressure within the main chamber, a hydraulic piston which is slidably disposed within the housing and connected with a valve, a multiple orifice unit which is slidably disposed within the hydraulic piston and forms an auxiliary chamber with the hydraulic piston, and the multiple orifice unit of which an orifice hole communicating the main chamber with the auxiliary chamber is formed thereto, and an orifice unit elastic portion which is disposed within the auxiliary chamber to elastically support the multiple orifice unit.

The multiple orifice unit may form a ramp chamber with the housing protruding portion when the valve is closed.

The hydraulic piston may include a hydraulic piston stepped portion bendingly formed in an end thereof, the multiple orifice unit may include a multiple orifice unit stepped portion bendingly formed in an end thereof, and a stepped portion oil line may be selectively formed between the hydraulic piston stepped portion and the multiple orifice unit stepped portion so as to selectively communicate the ramp chamber with the auxiliary chamber.

The hydraulic piston may be provided with a hydraulic pressure valve lash adjuster for adjusting a gap of the valve.

The hydraulic pressure valve lash adjuster may include a low pressure chamber formed in the hydraulic piston, a lash adjusting hydraulic pressure line formed in the housing, a low pressure chamber hydraulic pressure supply line formed in the hydraulic piston for connecting the low pressure chamber and the lash adjusting hydraulic pressure line, a lash adjuster housing forming high pressure chamber with the hydraulic piston and connected with the valve, a lash adjuster spring which is disposed between the lash adjuster housing and the hydraulic piston and elastically supports the lash adjuster housing, a communicating hole communicating the low pressure chamber with the high pressure chamber, a one-way valve which is disposed within the lash adjuster housing and selectively closes the communicating hole, and a one-way valve spring elastically supporting the one-way valve.

The hydraulic piston may be provided with a mechanical valve lash adjuster for adjusting a gap of the valve.

A swing arm may be disposed between the driving cam and the pump piston, and the pump piston may reciprocate by the swing arm.

The multiple orifice unit may be communicated with the main chamber by a hydraulic pump hydraulic pressure line insertedly formed therebetween.

Reciprocal motion directions of the pump piston and the hydraulic piston may not be parallel to each other.

The main chamber and the ramp chamber may be connected by a connecting hydraulic line formed therebetween, and a differential pressure valve may be disposed on the connecting hydraulic line.

The pump piston may be provided with a hydraulic pressure valve lash adjuster for adjusting a gap of the valve.

The hydraulic pressure valve lash adjuster may include a lash adjuster housing which forms a high pressure chamber with the pump piston and is slidably disposed within the housing, a low pressure chamber formed within the lash adjuster housing, a lash adjusting hydraulic pressure line formed in the housing, a low pressure chamber hydraulic pressure supply line which is formed in the pump piston for connecting the low pressure chamber and the lash adjusting hydraulic pressure line, a lash adjuster spring which is disposed between the lash adjuster housing and the pump piston for elastically supporting the lash adjuster housing, a communicating hole communicating the low pressure chamber with the high pressure chamber, a one-way valve which is disposed within the lash adjuster housing and selectively closes the communicating hole, and a one-way valve spring elastically supporting the one-way valve.

The hydraulic piston may include a hydraulic piston stepped portion bendingly formed on an end thereof, the multiple orifice unit comprises a multiple orifice unit stepped portion bendingly formed on an end thereof, and a stepped portion oil line is selectively formed between the hydraulic piston stepped portion and the multiple orifice unit stepped portion so as to selectively communicate the ramp chamber with the auxiliary chamber.

As described above, an electro-hydraulic variable valve lift apparatus according to various aspects of the present invention may adjust valve lift according to engine operation condition with simple scheme.

An electro-hydraulic variable valve lift apparatus according to various aspects of the present invention may form ramp profile when a valve is closed so as to reduce valve closing impact.

According to various aspects of the present invention, precise manufacturing of a multiple orifice and thus production cost may be reduced.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

BRIEF DESCRIPTION OF THE DRAWINGS

FIG. 3 is operational chart of an exemplary electro-hydraulic variable valve lift apparatus according to the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
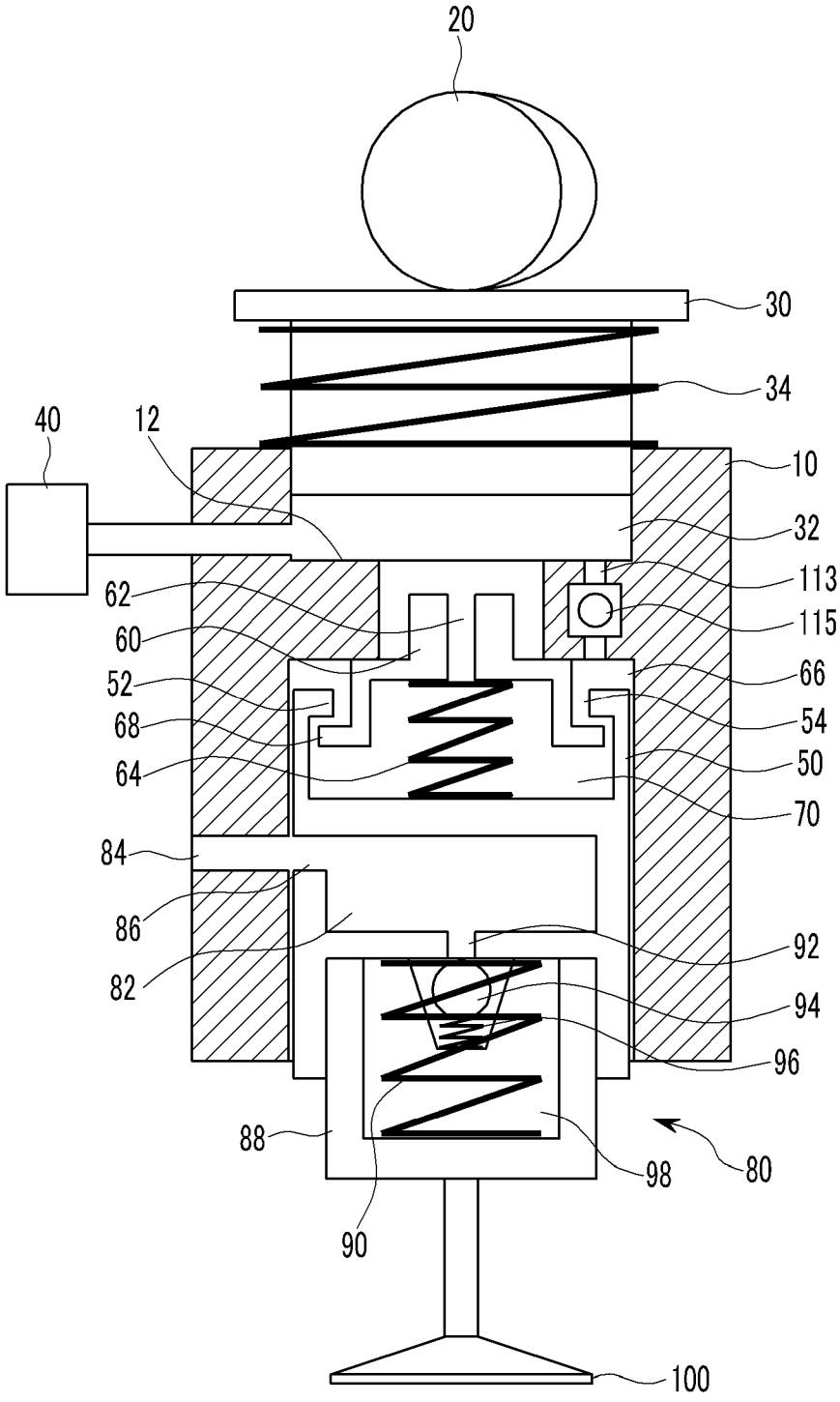
FIG. 1 is a cross-sectional view of an exemplary electro-hydraulic variable valve lift apparatus according to the present invention.
Figure 2:
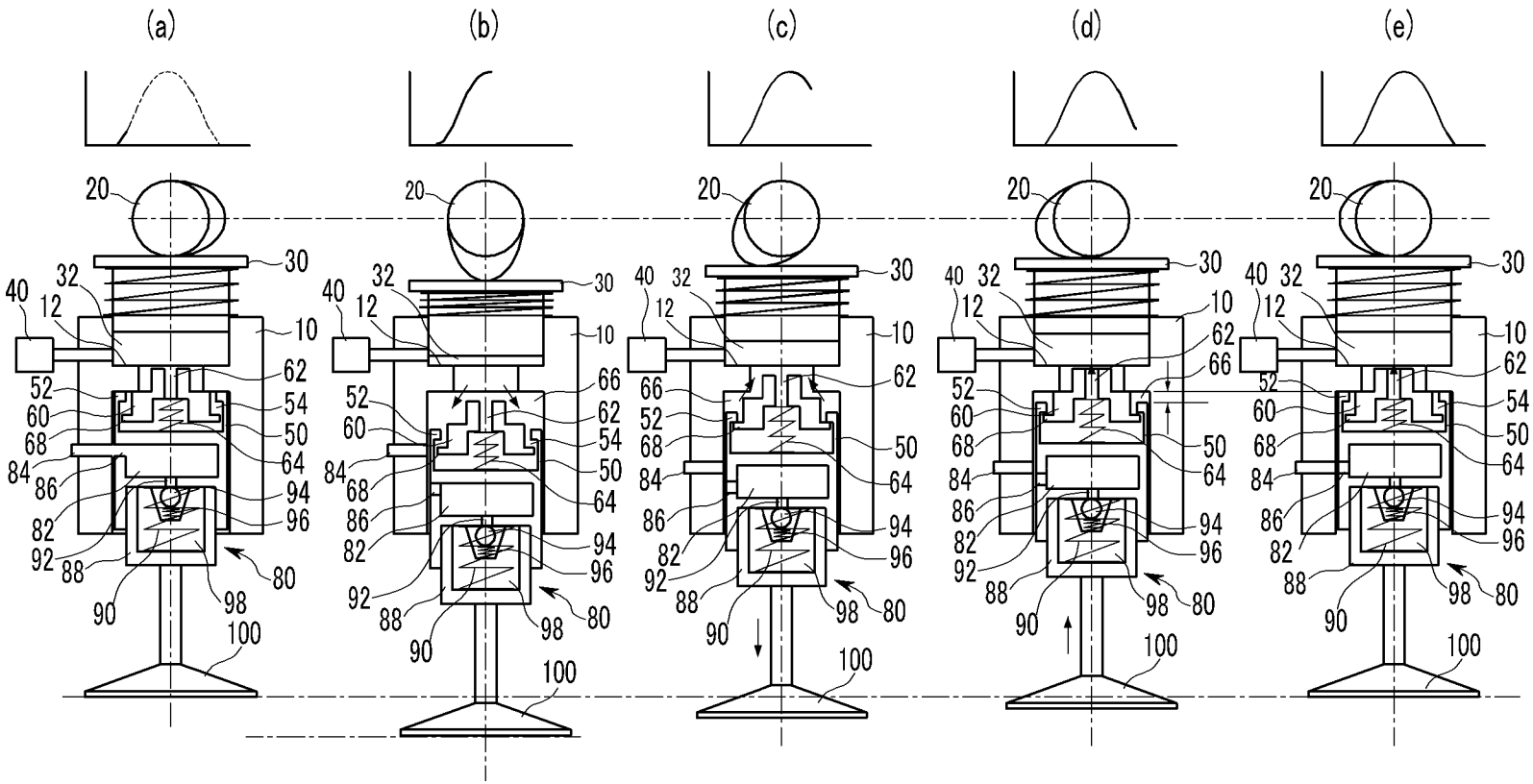
FIG. 2 is drawing showing operations of an exemplary electro-hydraulic variable valve lift apparatus according to the present invention.

Referring to FIG. 1 to FIG. 3, an electro-hydraulic variable valve lift apparatus according to various embodiments of the present invention includes a housing 10 of which a housing protruding portion 12 is formed therewithin, a driving cam 20, a pump piston 30 which forms a main chamber 32 with the housing 10, reciprocates within the housing 10 according to rotation of the driving cam 20, and forms hydraulic pressure within the main chamber 32, a pump piston elastic portion 34 which is disposed for elastically supporting the pump piston 30, an oil pressure controller 40 which is communicated with the main chamber 32 in order to control hydraulic pressure within the main chamber 32, a hydraulic piston 50 which is slidably disposed within the housing 10 and connected with a valve 100, a multiple orifice unit 60 which is slidably disposed within the hydraulic piston 50 and forms an auxiliary chamber 70 with the hydraulic piston 50, and the multiple orifice unit 60 of which an orifice hole 62 communicating the main chamber 32 with the auxiliary chamber 70 is formed thereto, and an orifice unit elastic portion 64 which is disposed within the auxiliary chamber 70 to elastically support the multiple orifice unit 60.

The multiple orifice unit 60 forms a ramp chamber 66 with the housing protruding portion 12 when the valve 100 is closed.

The hydraulic piston 50 includes a hydraulic piston stepped portion 52 bendingly formed on an end thereof (e.g., radially extending from an end thereof), the multiple orifice unit 60 includes a multiple orifice unit stepped portion 68 bendingly formed on an end thereof (e.g., radially extending from an end thereof), and a stepped portion oil line 54 is selectively formed between the hydraulic piston stepped portion 52 and the multiple orifice unit stepped portion 68 so as to selectively communicate the ramp chamber 66 with the auxiliary chamber 70.

The hydraulic piston 50 is provided with a hydraulic pressure valve lash adjuster 80 for adjusting a gap of the valve 100.

The hydraulic pressure valve lash adjuster 80 includes a low pressure chamber 82 formed in the hydraulic piston 50, a lash adjusting hydraulic pressure line 84 formed in the housing 10, a low pressure chamber hydraulic pressure supply line 86 formed in the hydraulic piston 50 for connecting the low pressure chamber 82 and the lash adjusting hydraulic pressure line 84, a lash adjuster housing 88 forming high pressure chamber 98 with the hydraulic piston 50 and connected with the valve 100, a lash adjuster spring 90 which is disposed between the lash adjuster housing 88 and the hydraulic piston 50 and elastically supports the lash adjuster housing 88, a communicating hole 92 communicating the low pressure chamber 82 with the high pressure chamber 98, a one-way valve 94 which is disposed within the lash adjuster housing 88 and selectively closes the communicating hole 92, and a one-way valve spring 96 elastically supporting the one-way valve 94.

The main chamber 32 and the ramp chamber 66 is connected by a connecting hydraulic line 113 formed therebetween, and a differential pressure valve 115 is disposed on the connecting hydraulic line 113.

The differential pressure valve 114 may exhaust air within the main chamber 32 and the ramp chamber 66 and minimize pulsation due to rapid pressure change.

Hereinafter, referring to FIG. 1 to FIG. 3, operations of the electro-hydraulic variable valve lift apparatus according to various embodiments of the present invention will be explained.

The housing protruding portion 12 contacts the multiple orifice unit 60 just before the valve 100 is opened, According to rotation of the driving cam 20, as shown in (a) of FIG. 2, oil in the main chamber 32 flows into the auxiliary chamber 70 through the orifice hole 62 and simultaneously the multiple orifice unit 60 moves downward.

And thus, at the moment of opening of the valve 100, valve profile is formed smoothly.

After that, as shown in (b) of FIG. 2, the oil in the main chamber 32 flows into the ramp chamber 66 and the valve 100 is opened realizing normal valve profile.

Referring to (c), (d) and (e) of FIG. 2, oil in the ramp chamber 66 flows into the main chamber 32 during the hydraulic piston stepped portion 52 contacting the multiple orifice unit stepped portion 68 due to elastic force of the orifice unit elastic portion 64.

And then, after the housing protruding portion 12 contacts the multiple orifice unit 60, the hydraulic piston stepped portion 52 is separated from the multiple orifice unit stepped portion 68 and the oil in the ramp chamber 66 flows into the main chamber 32 through the orifice hole 62.

Since at the moment of closing of the valve 100, the oil is exhausted through just the orifice hole 62, the ramp profile is realized.

That is, the multiple orifice unit 60 is provided to the electro-hydraulic variable valve lift apparatus according to various embodiments of the present invention and thus smooth valve closing and opening may be realized and durability of an engine may be increased.

Hereinafter, referring to FIG. 1 to FIG. 3, operations of the electro-hydraulic variable valve lift apparatus illustrated in these figures according to engine load will be explained.

As shown FIG. 1 to in FIG. 3, in high load of the electro-hydraulic variable valve lift apparatus according to various embodiments, the oil pressure controller 40 supplies oil to the main chamber 32 and then closed.

The hydraulic piston 50 reciprocates according to rotation of the driving cam 20 and the valve 100 is opened as shown in FIG. 2.

In the middle load of various embodiments of the present invention, the main chamber 32 is filled with oil by the oil pressure controller 40 and then the oil pressure controller 40 is closed.

When the driving cam 20 is positioned as shown in (b) of FIG. 2, the oil pressure controller 40 releases the oil in the main chamber 32.

The oil pressure controller 40 is controlled by an ECU (electronic control unit; not shown), and since operations of the oil pressure controller 40 are not necessary for explaining the present invention and thus description of the operation of the oil pressure controller 40 will be omitted.

Operations of opening of the valve 100 are the same as the operations in the high load, and thus detailed explanation will be omitted.

When the valve 100 is closed, oil in the main chamber 32 is released through the oil pressure controller 40 and thus valve profile forms a rapid slope, That is, as shown in FIG. 2, a period of valve opening in the middle load is shorter than a period of valve opening in the high load.

In the middle load, since the oil is exhausted through just the orifice hole 62, the ramp profile is realized.

In the low load of various embodiments of the present invention, the main chamber 32 is filled with oil by the oil pressure controller 40 and then the oil pressure controller 40 is closed. Before the driving cam 20 is positioned to top position as shown in (b) of FIG. 2, the oil pressure controller 40 releases the oil in the main chamber 32.

Before the driving cam 20 reaches the top position, the oil pressure controller 40 is opened to release hydraulic pressure within the main chamber 32, and thus valve lift is reduced and opening period of the valve 100 is relatively reduced.

In CDA (cylinder deactivation) mode, the oil pressure controller 40 is kept in opening state.

Since hydraulic pressure is not supplied to the main chamber 32, although the driving cam 20 rotates, the pump piston 30 do not moves (lost motion) and the valve 100 is not opened.

The oil pressure controller 40 repeats supplying and releasing of the hydraulic pressure according to operation conditions of the engine, and if timing of releasing the hydraulic pressure is controlled, the electro-hydraulic variable valve lift apparatus according to various embodiments of the present invention realizes various valve profiles.

Hereinafter, referring to FIG. 1 to FIG. 3, operations of the hydraulic pressure valve lash adjuster 80 will be explained.

At the moment the valve 100 is closed, hydraulic pressure is supplied to the low pressure chamber 82 through the lash adjusting hydraulic pressure line 84 and the low pressure chamber hydraulic pressure supply line 86.

If a gap is generated between the valve 100 and a valve seat (not shown), hydraulic pressure is supplied from the low pressure chamber 82 to the high pressure chamber 98 so as to adjust the gap during the hydraulic piston 50 reciprocates.

If a gap is in proper range, the one-way valve 94 closes the communicating hole 92 by elastic force of the one-way valve spring 96 and thus the valve 100 is opened constantly.

The hydraulic pressure valve lash adjuster 80 may be formed integrally with the second body 56, and in this case, scheme of the entire electro-hydraulic variable valve lift apparatus may be simple and numbers of the elements and manufacturing cost may be reduced.

Figure 4:
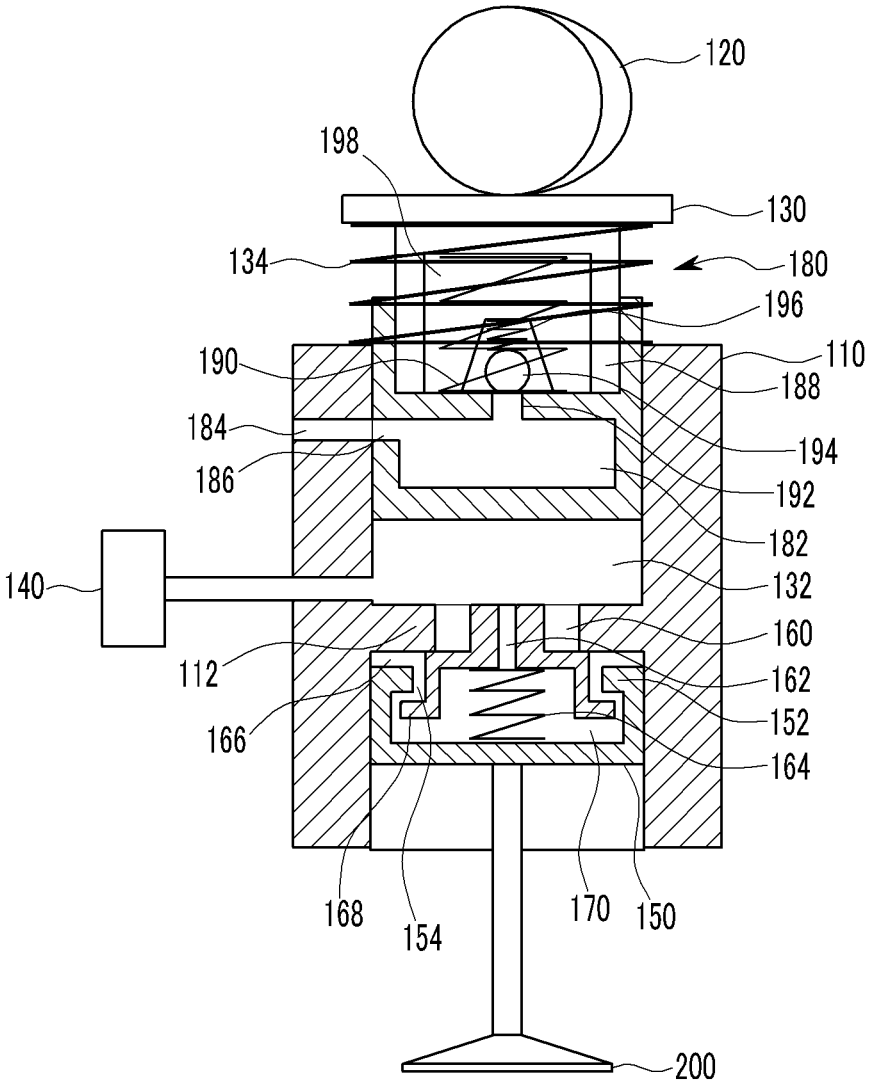
FIG. 4 is a cross-sectional view of an exemplary electro-hydraulic variable valve lift apparatus according to the present invention.
Figure 5:
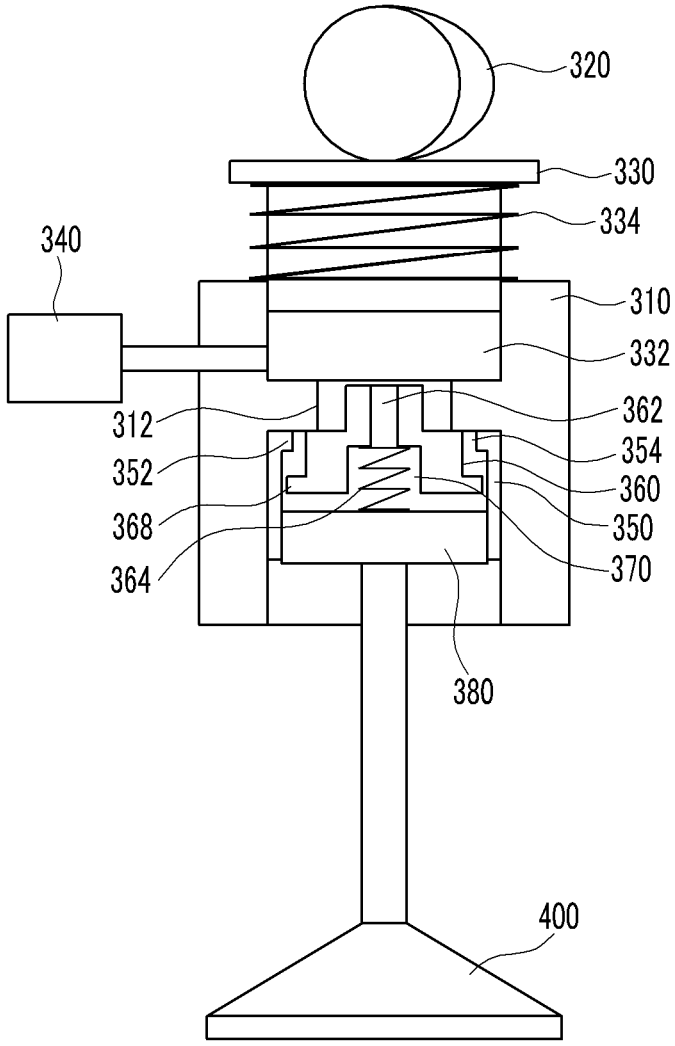
FIG. 5 is a cross-sectional view of an exemplary electro-hydraulic variable valve lift apparatus according the present invention.
Figure 6:
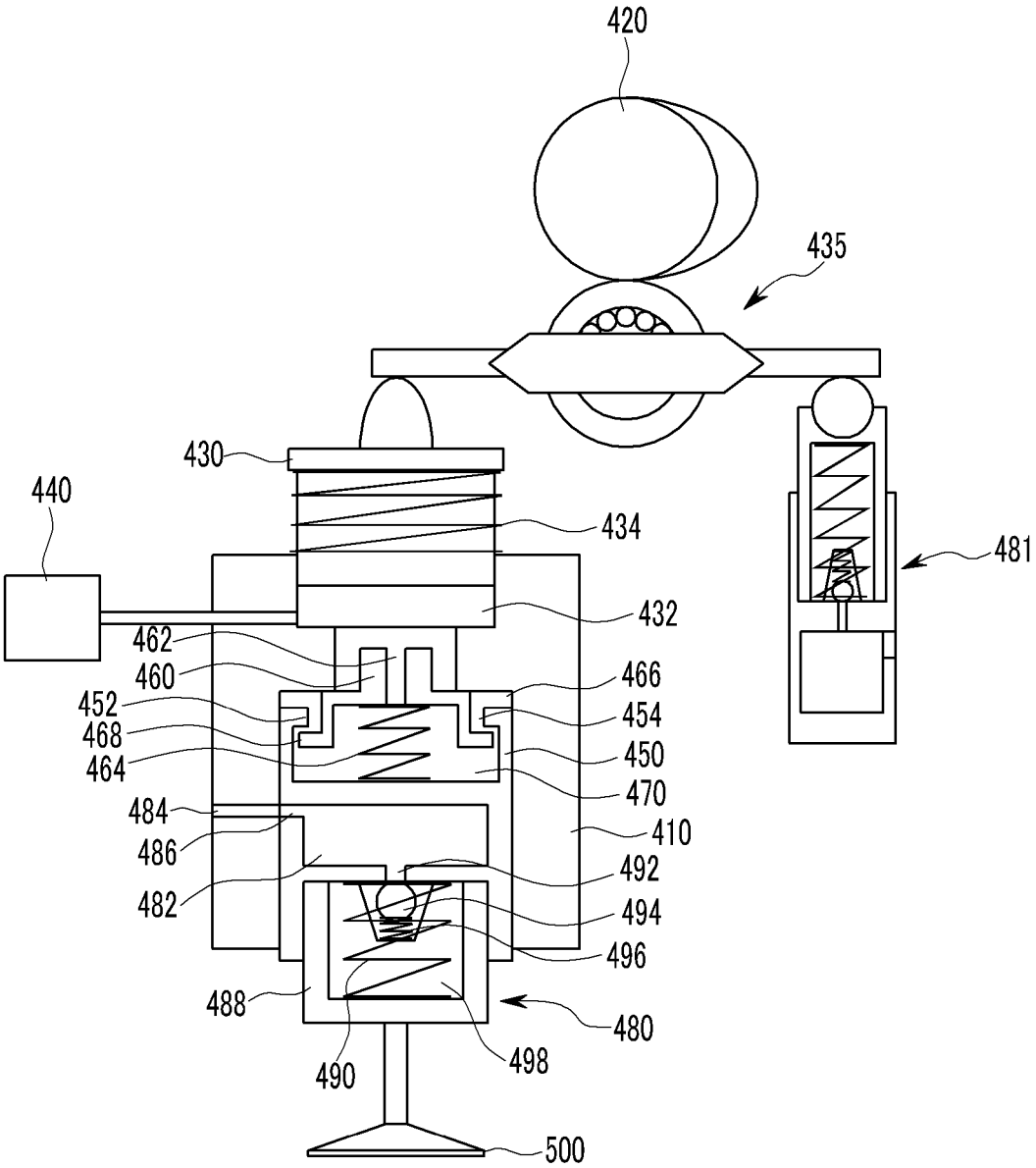
FIG. 6 is a cross-sectional view of an exemplary electro-hydraulic variable valve lift apparatus according to the present invention.

Referring to FIG. 4, an electro-hydraulic variable valve lift apparatus according to various embodiments of the present invention will be described.

The electro-hydraulic variable valve lift apparatus according to various embodiments of the present invention includes a housing 110 of which a housing protruding portion 112 is formed therewithin, a driving cam 120, a pump piston 130 which forms a main chamber 132 with the housing 110, reciprocates within the housing 110 according to rotation of the driving cam 120, and forms hydraulic pressure within the main chamber 132, a pump piston elastic portion 134 which is disposed for elastically supporting the pump piston 130, an oil pressure controller 140 which is communicated with the main chamber 132 in order to control hydraulic pressure within the main chamber 132, a hydraulic piston 150 which is slidably disposed within the housing 110 and connected with a valve 200, a multiple orifice unit 160 which is slidably disposed within the hydraulic piston 150 and forms an auxiliary chamber 170 with the hydraulic piston 150, and the multiple orifice unit 160 of which an orifice hole 162 communicating the main chamber 132 with the auxiliary chamber 170 is formed thereto, and an orifice unit elastic portion 164 which is disposed within the auxiliary chamber 170 to elastically support the multiple orifice unit 160.

The multiple orifice unit 160 forms a ramp chamber 166 with the housing protruding portion 112 when the valve 200 is closed.

The hydraulic piston 150 includes a hydraulic piston stepped portion 152 bendingly formed on an end thereof, the multiple orifice unit 160 includes a multiple orifice unit stepped portion 168 bendingly formed on an end thereof, and a stepped portion oil line 154 is selectively formed between the hydraulic piston stepped portion 152 and the multiple orifice unit stepped portion 168 so as to selectively communicate the ramp chamber 166 with the auxiliary chamber 170.

The pump piston 130 is provided with a hydraulic pressure valve lash adjuster 180 for adjusting a gap of the valve 200.

The hydraulic pressure valve lash adjuster 180 includes a lash adjuster housing 180 which forms a high pressure chamber 198 with the pump piston 130 and is slidably disposed within the housing 110, a low pressure chamber 182 formed within the lash adjuster housing 188, a lash adjusting hydraulic pressure line 184 formed in the housing 110, a low pressure chamber hydraulic pressure supply line 186 which is formed in the pump piston 130 for connecting the low pressure chamber 182 and the lash adjusting hydraulic pressure line 184, a lash adjuster spring 190 which is disposed between the lash adjuster housing 188 and the pump piston 130 for elastically supporting the lash adjuster housing 188, a communicating hole 192 communicating the low pressure chamber 182 with the high pressure chamber 198, a one-way valve 194 which is disposed within the lash adjuster housing 188 and selectively closes the communicating hole 192, and a one-way valve spring 196 elastically supporting the one-way valve 194.

Operations and scheme of the illustrated electro-hydraulic variable valve lift apparatus are similar to the operations and scheme of the electro-hydraulic variable valve lift apparatus described above except for the hydraulic pressure valve lash adjuster 180, and thus repeated explanation will be omitted.

An electro-hydraulic variable valve lift apparatus according to various embodiments of the present invention includes a housing 310 of which a housing protruding portion 312 is formed therewithin, a driving cam 320, a pump piston 330 which forms a main chamber 332 with the housing 310, reciprocates within the housing 310 according to rotation of the driving cam 320, and forms hydraulic pressure within the main chamber 332, a pump piston elastic portion 334 which is disposed for elastically supporting the pump piston 330, an oil pressure controller 340 which is communicated with the main chamber 332 in order to control hydraulic pressure within the main chamber 332, a hydraulic piston 350 which is slidably disposed within the housing 310 and connected with a valve 400, a multiple orifice unit 360 which is slidably disposed within the hydraulic piston 350 and forms an auxiliary chamber 370 with the hydraulic piston 350, and the multiple orifice unit 360 of which an orifice hole 362 communicating the main chamber 332 with the auxiliary chamber 370 is formed thereto, and an orifice unit elastic portion 364 which is disposed within the auxiliary chamber 370 to elastically support the multiple orifice unit 360.

The multiple orifice unit 360 forms a ramp chamber 366 with the housing protruding portion 312 when the valve 400 is closed.

The hydraulic piston 350 includes a hydraulic piston stepped portion 352 bendingly formed on an end thereof, the multiple orifice unit 360 includes a multiple orifice unit stepped portion 368 bendingly formed on an end thereof, and a stepped portion oil line 354 is selectively formed between the hydraulic piston stepped portion 352 and the multiple orifice unit stepped portion 368 so as to selectively communicate the ramp chamber 366 with the auxiliary chamber 370.

In various embodiments of the present invention, a mechanical valve lash adjuster 380 is provided for adjusting a gap of the valve 400 so as to simplify scheme.

Structure and operation of the mechanical valve lash adjuster 380 are obvious to a person skilled in the art, so that detailed explanation will be omitted.

Operations of the illustrated electro-hydraulic variable valve lift apparatus are similar to the operations of the electro-hydraulic variable valve lift apparatus described above, and thus detailed explanation will be omitted.

An electro-hydraulic variable valve lift apparatus according to various embodiments of the present invention includes a housing 410 of which a housing protruding portion 412 is formed therewithin, a driving cam 420, a pump piston 430 which forms a main chamber 432 with the housing 410, reciprocates within the housing 410 according to rotation of the driving cam 420, and forms hydraulic pressure within the main chamber 432, a pump piston elastic portion 434 which is disposed for elastically supporting the pump piston 430, an oil pressure controller 440 which is communicated with the main chamber 432 in order to control hydraulic pressure within the main chamber 432, a hydraulic piston 450 which is slidably disposed within the housing 410 and connected with a valve 500, a multiple orifice unit 460 which is slidably disposed within the hydraulic piston 450 and forms an auxiliary chamber 470 with the hydraulic piston 450, and the multiple orifice unit 460 of which an orifice hole 462 communicating the main chamber 432 with the auxiliary chamber 470 is formed thereto, and an orifice unit elastic portion 464 which is disposed within the auxiliary chamber 470 to elastically support the multiple orifice unit 460.

The multiple orifice unit 460 forms a ramp chamber 466 with the housing protruding portion 412 when the valve 500 is closed.

The hydraulic piston 450 includes a hydraulic piston stepped portion 452 bendingly formed on an end thereof, the multiple orifice unit 460 includes a multiple orifice unit stepped portion 468 bendingly formed on an end thereof, and a stepped portion oil line 454 is selectively formed between the hydraulic piston stepped portion 452 and the multiple orifice unit stepped portion 468 so as to selectively communicate the ramp chamber 466 with the auxiliary chamber 470.

A swing arm 435 is disposed between the driving cam 420 and the pump piston 430 for the pump piston 430 to reciprocate by the swing arm 435, and a hydraulic pressure valve lash adjuster 481 or a mechanical valve lash adjuster 481 may be disposed to an end of the swing arm 435. And also, a hydraulic pressure valve lash adjuster 480 for adjusting a gap of the valve 500 or a mechanical hydraulic pressure valve lash adjuster may be disposed to the hydraulic piston 450.

Operations and scheme of the illustrated electro-hydraulic variable valve lift apparatus are similar to the operations of the electro-hydraulic variable valve lift apparatus described above except for the swing arm 435, and thus repeated explanation will be omitted.

An electro-hydraulic variable valve lift apparatus according to various embodiments of the present invention includes a housing 510 of which a housing protruding portion 512 is formed therewithin, a driving cam 520, a pump piston 530 which forms a main chamber 532 with the housing 510, reciprocates within the housing 510 according to rotation of the driving cam 520, and forms hydraulic pressure within the main chamber 532, a pump piston elastic portion 534 which is disposed for elastically supporting the pump piston 530, an oil pressure controller 540 which is communicated with the main chamber 532 in order to control hydraulic pressure within the main chamber 532, a hydraulic piston 550 which is slidably disposed within the housing 510 and connected with a valve 600, a multiple orifice unit 560 which is slidably disposed within the hydraulic piston 550 and forms an auxiliary chamber 570 with the hydraulic piston 550, and the multiple orifice unit 560 of which an orifice hole 562 communicating the main chamber 532 with the auxiliary chamber 570 is formed thereto, and an orifice unit elastic portion 564 which is disposed within the auxiliary chamber 570 to elastically support the multiple orifice unit 560.

The multiple orifice unit 560 forms a ramp chamber 566 with the housing protruding portion 512 when the valve 600 is closed.

The hydraulic piston 550 includes a hydraulic piston stepped portion 552 bendingly formed on an end thereof, the multiple orifice unit 560 includes a multiple orifice unit stepped portion 568 bendingly formed on an end thereof, and a stepped portion oil line 554 is selectively formed between the hydraulic piston stepped portion 552 and the multiple orifice unit stepped portion 568 so as to selectively communicate the ramp chamber 566 with the auxiliary chamber 570.

The hydraulic piston 550 is provided with a hydraulic pressure valve lash adjuster 580 for adjusting a gap of the valve 600.

Operations and scheme of the hydraulic pressure valve lash adjuster 580 is similar to the hydraulic pressure valve lash adjuster described above, and thus repeated explanation will be omitted.

In various embodiments of the present invention, a hydraulic pump hydraulic pressure line 536 is formed between the multiple orifice unit 560 and the main chamber 532 to be communicated with each other.

Figure 7:
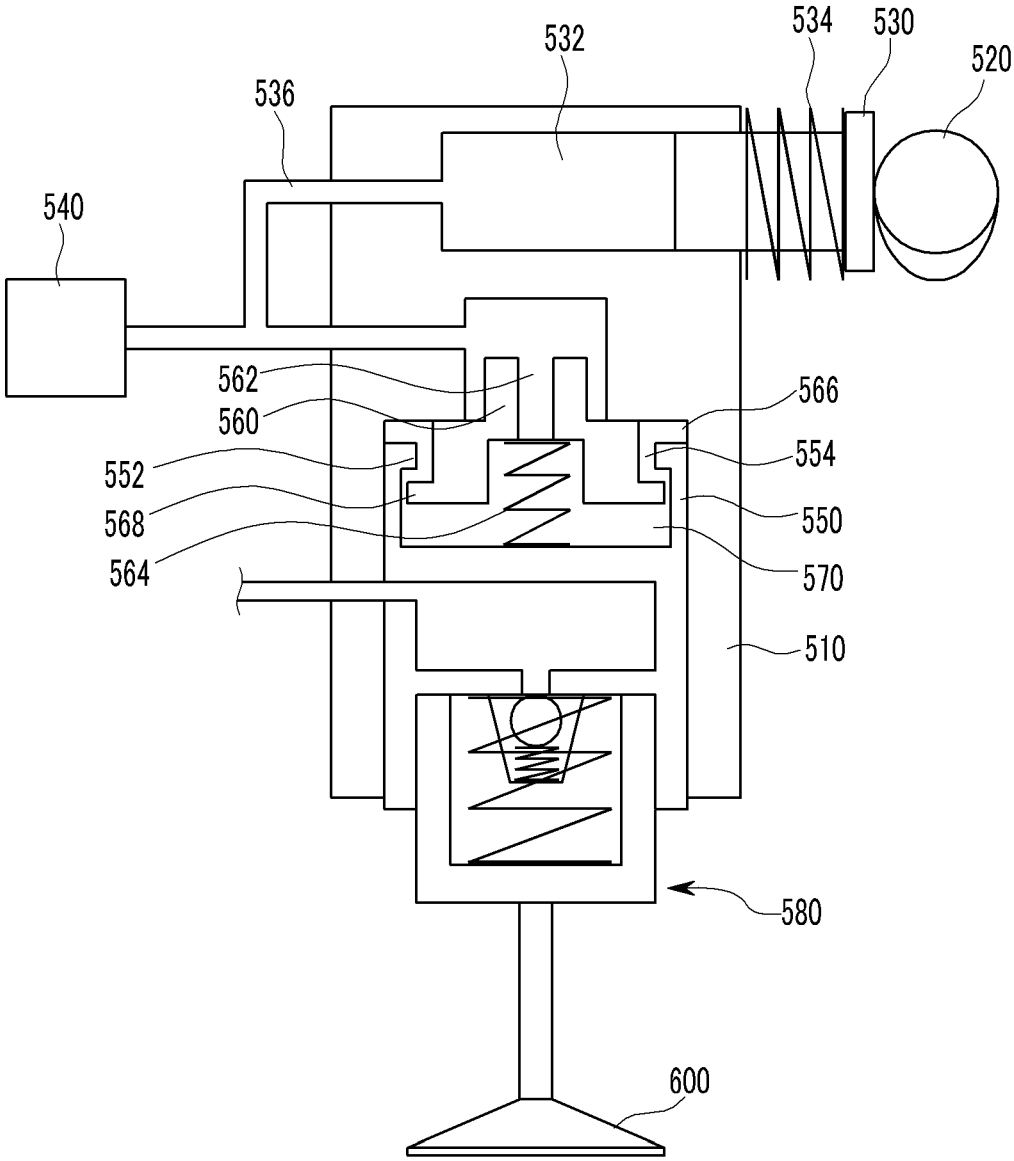
FIG. 7 is a cross-sectional view of an exemplary electro-hydraulic variable valve lift apparatus according to the present invention.

In this case, since reciprocal motion directions of the pump piston 530 and the hydraulic piston 550 do not need to be parallel each other, as shown in FIG. 7, the pump piston 530 may be vertically mounted to the housing 510 regardless positions of the driving cam 520.

And thus, design freedom of a valve train, a cylinder head and so on may be improved.

Operations and scheme of the illustrated electro-hydraulic variable valve lift apparatus are similar to the operations of the electro-hydraulic variable valve lift apparatus described above, and thus repeated explanation will be omitted.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electro-hydraulic variable valve lift apparatus comprising:

a housing including a housing protruding portion formed therein;

a driving cam;

a pump piston received in a main chamber of the housing that reciprocates within the housing according to rotation of the driving cam, and which forms hydraulic pressure within the main chamber;

a pump piston elastic portion elastically supporting the pump piston;

an oil pressure controller in fluid communication with the main chamber to control hydraulic pressure within the main chamber;

a hydraulic piston slidably disposed within the housing and operably connected with a valve;

a multiple orifice unit slidably disposed within the hydraulic piston forming an auxiliary chamber with the hydraulic piston, the multiple orifice unit including an orifice hole communicating the main chamber with the auxiliary chamber; and an orifice unit elastic portion disposed within the auxiliary chamber to elastically support the multiple orifice unit.

2. The electro-hydraulic variable valve lift apparatus of claim 1, wherein the multiple orifice unit forms a ramp chamber with the housing protruding portion when the valve is closed.

3. The electro-hydraulic variable valve lift apparatus of claim 2, wherein:

the hydraulic piston comprises a hydraulic piston stepped portion bendingly formed on an end thereof;

the multiple orifice unit comprises a multiple orifice unit stepped portion radially extending from an end thereof; and a stepped portion oil line is formed between the hydraulic piston stepped portion and the multiple orifice unit stepped portion so as to selectively communicate the ramp chamber with the auxiliary chamber.

4. The electro-hydraulic variable valve lift apparatus of claim 1, wherein the hydraulic piston is provided with a hydraulic pressure valve lash adjuster for adjusting a gap of the valve.

5. The electro-hydraulic variable valve lift apparatus of claim 4, wherein the hydraulic pressure valve lash adjuster comprises:

a low pressure chamber formed within the hydraulic piston;

a lash adjusting hydraulic pressure line formed in the housing;

a low pressure chamber hydraulic pressure supply line formed in the hydraulic piston for connecting the low pressure chamber and the lash adjusting hydraulic pressure line;

a lash adjuster housing forming a high pressure chamber with the hydraulic piston and connected with the valve;

a lash adjuster spring disposed between the lash adjuster housing and the hydraulic piston and elastically supports the lash adjuster housing;

a communicating hole communicating the low pressure chamber with the high pressure chamber;

a one-way valve disposed within the lash adjuster housing and selectively closes the communicating hole; and a one-way valve spring elastically supporting the one-way valve.

6. The electro-hydraulic variable valve lift apparatus of claim 2, wherein the hydraulic piston is provided with a mechanical valve lash adjuster for adjusting a gap of the valve.

7. The electro-hydraulic variable valve lift apparatus of claim 2, wherein a swing arm is disposed between the driving cam and the pump piston, and the pump piston reciprocates by the swing arm.

8. The electro-hydraulic variable valve lift apparatus of claim 2, wherein the multiple orifice unit is communicated with the main chamber by a hydraulic pump hydraulic pressure line insertedly formed therebetween.

9. The electro-hydraulic variable valve lift apparatus of claim 8, reciprocal motion directions of the pump piston and the hydraulic piston are not parallel to each other.

10. The electro-hydraulic variable valve lift apparatus of claim 2, wherein:

the main chamber and the ramp chamber are connected by a connecting hydraulic line formed therebetween; and a differential pressure valve is disposed on the connecting hydraulic line.

11. The electro-hydraulic variable valve lift apparatus of claim 2, wherein the pump piston is provided with a hydraulic pressure valve lash adjuster for adjusting a gap of the valve.

12. The electro-hydraulic variable valve lift apparatus of claim 11, wherein the hydraulic pressure valve lash adjuster comprises:

a lash adjuster housing which forms a high pressure chamber with the pump piston and is slidably disposed within the housing;

a low pressure chamber formed within the lash adjuster housing;

a lash adjusting hydraulic pressure line formed in the housing;

a low pressure chamber hydraulic pressure supply line formed in the pump piston for connecting the low pressure chamber and the lash adjusting hydraulic pressure line;

a lash adjuster spring disposed between the lash adjuster housing and the pump piston for elastically supporting the lash adjuster housing;

a communicating hole communicating the low pressure chamber with the high pressure chamber;

a one-way valve disposed within the lash adjuster housing and selectively closes the communicating hole; and a one-way valve spring elastically supporting the one-way valve.

13. The electro-hydraulic variable valve lift apparatus of claim 11, wherein:

the hydraulic piston comprises a hydraulic piston stepped portion radially extending from an end thereof;

the multiple orifice unit comprises a multiple orifice unit stepped portion radially extending from an end thereof; and a stepped portion oil line is selectively formed between the hydraulic piston stepped portion and the multiple orifice unit stepped portion so as to selectively communicate the ramp chamber with the auxiliary chamber.

* * * * *